US012409369B2

(12) United States Patent
Geller et al.

(10) Patent No.: US 12,409,369 B2
(45) **Date of Patent: *Sep. 9, 2025**

(54) GOLF BALL TEEING DEVICE AND STAND THEREFOR

(71) Applicant: Tee Tender LLC, Mount Kisco, NY (US)

(72) Inventors: Stanley Geller, Northvale, NJ (US); Robert Pascale, Matthews, NC (US)

(73) Assignee: TEE TENDER LLC, Mt. Kisco, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/428,000

(22) Filed: Jan. 31, 2024

(65) Prior Publication Data

US 2024/0350880 A1 Oct. 24, 2024

Related U.S. Application Data

(62) Division of application No. 18/116,027, filed on Mar. 1, 2023, now Pat. No. 11,918,872.

(60) Provisional application No. 63/423,859, filed on Nov. 9, 2022, provisional application No. 63/320,781, filed on Mar. 17, 2022.

(51) Int. Cl.
*A63B 57/00* (2015.01)

(52) U.S. Cl.
CPC ..... *A63B 57/0037* (2013.01)

(58) Field of Classification Search
CPC .... A63B 57/0037; A63B 55/10; A01K 97/10; F16M 11/046
See application file for complete search history.

(56) References Cited

U.S. PATENT DOCUMENTS 465,222 A * 12/1891 Ulbricht ..... B66C 1/48 294/115
877,389 A * 1/1908 Werd ..... B25B 9/00 294/115
2,191,170 A * 2/1940 Keehn ..... A01K 97/14 294/19.3
2,609,198 A 9/1952 Armstrong
3,841,686 A * 10/1974 Gallo ..... E01H 1/1206 294/1.4
4,226,389 A 10/1980 Neth
4,483,562 A * 11/1984 Schoolman ..... A61B 17/29 606/174
4,526,369 A 7/1985 Phelps
4,609,174 A 9/1986 Nakatani
4,616,826 A 10/1986 Trefts
(Continued)

FOREIGN PATENT DOCUMENTS

GB 2503709 A * 1/2014 ..... B25B 9/00
JP 4293804 A 7/2009
(Continued)

OTHER PUBLICATIONS

Cambridge Dictionary, <dictionary.cambridge.org/us/dictionary/english/button>, retrieved on Jan. 30, 2025. (Year: 2025).*

*Primary Examiner* — Steven B Wong
(74) *Attorney, Agent, or Firm* — Dilworth & Barrese, LLP.; Michael J. Musella, Esq.

(57) ABSTRACT

A golf ball teeing device allows a tee with a golf ball balanced thereon, to be securely pierced into the ground, without having to bend over.

15 Claims, 16 Drawing Sheets

(56) References Cited

U.S. PATENT DOCUMENTS 4,819,938 A * 4/1989 Hill ..... A63B 47/02 473/133
4,951,947 A 8/1990 Kopfle
4,962,957 A * 10/1990 Traber ..... B25J 1/04 294/100
5,080,357 A 1/1992 Wolf
5,308,029 A 5/1994 Bingham
5,310,177 A 5/1994 Conrad et al.
5,335,953 A 8/1994 Luther, Sr.
5,380,054 A * 1/1995 Galvis ..... E01H 1/1206 294/1.4
5,482,247 A 1/1996 Smith
5,499,813 A 3/1996 Black
5,503,394 A 4/1996 Mauck et al.
5,669,646 A 9/1997 Fiocca et al.
5,672,121 A 9/1997 Miller
5,707,303 A 1/1998 Berkowitz et al.
5,759,117 A 6/1998 Erickson, Jr.
6,338,685 B1 1/2002 Posluszny
6,461,254 B1 10/2002 Ballett et al.
6,508,496 B1 * 1/2003 Huang ..... E01H 1/12 294/115
6,716,118 B1 4/2004 Asta
6,843,737 B1 * 1/2005 Smith ..... A63B 57/0037 473/386
6,878,071 B1 4/2005 Schwieger et al.
6,887,169 B2 5/2005 Whitehill et al.
7,226,098 B1 * 6/2007 Moreira ..... E01H 1/1206 294/1.4
7,344,171 B1 * 3/2008 McMullan ..... E01H 1/1206 294/902
7,351,156 B1 4/2008 Panneri et al.
7,963,854 B2 6/2011 Nugent et al.
8,529,379 B1 9/2013 Faircloth
8,870,686 B1 10/2014 Johnson
9,217,231 B2 * 12/2015 Briski ..... E01H 1/1206
9,950,227 B1 4/2018 Faircloth
10,238,936 B2 3/2019 Jensen
D903,024 S 11/2020 Mickley
11,118,726 B2 9/2021 Gribble et al.
11,179,612 B2 11/2021 Nappe
11,400,353 B1 8/2022 Mecham
11,918,872 B2 * 3/2024 Geller ..... A63B 47/00
2003/0102414 A1 6/2003 Smart
2003/0203772 A1 10/2003 Paine
2003/0234326 A1 12/2003 Crain et al.
2004/0029653 A1 2/2004 Whitehill et al.
2005/0170904 A1 8/2005 Smeeth
2006/0014596 A1 1/2006 Marcus et al.
2006/0199671 A1 9/2006 Town
2007/0072691 A1 3/2007 Berry
2007/0184918 A1 8/2007 Ritch, Jr.
2007/0219014 A1 9/2007 Merriman
2007/0293353 A1 12/2007 Irwin
2018/0369664 A1 12/2018 Jensen
2023/0302336 A1 * 9/2023 Blain ..... A63B 71/023

FOREIGN PATENT DOCUMENTS

WO 2006/043282 A1 4/2006
WO 2014/170906 A1 10/2014
WO WO-2022029726 A1 * 2/2022 ..... A63B 47/00

* cited by examiner

GOLF BALL TEEING DEVICE AND STAND THEREFOR

BACKGROUND OF THE INVENTION

The present invention is directed to a golf ball teeing device which allows a golf ball to be placed on a tee and then implanted in the ground, without the golfer having to bend over. More particularly, the present invention is directed to such teeing device which reliably secures such a golf ball and tee on the ground, requiring a minimum of mechanical components which reliably perform with minimal amount of maintenance required or danger of breaking.

Golf ball teeing devices are known to provide for inserting a tee in the ground with a golf ball placed thereon. For example, WO 2022/029726 discloses such a golf aid device including a first spring interconnecting jaws for holding the golf ball and tee, and biasing such jaws closed. The jaws are interconnected by a taut cable interconnecting the jaws to a button at a remote end of the device. Depressing this button slackens the cable, allowing a second spring to bias the jaws into open position, and release the golf ball and tee from grip of the jaws.

U.S. Pat. Pub. No. 2004/0029633 is also directed to a golf ball and tee setter having a spring laterally biasing jaws of a ball cage closed, with downward pressure from a push rod at a remote end forcing the jaws open against the action of the spring. However, such devices require a large number of springs often biasing in opposition to one another. Such springs have finite operational life and can be easily deformed and bent out of shape.

Accordingly, it is an object of the present invention to improve reliably of mounting a golf ball and tee on the ground, especially from a standing position.

It is also an object of the present invention to provide for such mounting of a golf ball and tee with a device requiring a minimal number of components that can be easily serviced and not prone to breakage.

It is another object of the present invention to allow such golf ball teeing device to be securely mounted on the ground in upright position, when not in use.

SUMMARY OF THE INVENTION

These and other objects are provided by present invention, which is directed to a golf ball teeing device which allows a tee with a golf ball balanced thereon, to be securely pierced into the ground, without having to bend over.

The jaws of the device are biased closed, with a golf ball first positioned therebetween, and then a tee slid on top of the golf ball while the device is inverted. Then, the device is inverted and the tee pierced into the ground. A button on an opposite end of the device is then depressed to bias the jaws apart against action of biasing means and release both the tee and golf ball situated thereon.

More particularly, the golf ball teeing device has a seat for a golf ball, a pair of jaws arranged on either side of the golf ball seat and forming an opening for a tee for the golf ball at mating ends thereof, means for biasing the jaws together, a rod arranged to open the jaws against the biasing and release the golf ball and tee from therebetween, a tubular shaft on which the jaws are pivotally mounted, and through which the rod movably extends along the shaft, the rod being configured, when pushed, to contact the jaws and pivotally open them against said biasing means, a meshing gear situated at an end of the rod, and a pair of meshing gears each pivotally arranged on a respective jaw and interlocking with the meshing gear at the end of the rod. Pushing the rod against the action of the biasing means pivots the jaws outwardly from one another.

This arrangement facilitates mounting of a golf ball and tee during golfing, with minimal effort, and avoiding components prone to failure or distortion. A stand for securely mounting the teeing device in upright position is also provided.

BRIEF DESCRIPTION OF THE DRAWINGS

The features of the present invention will be described in greater detail with reference to the accompanying drawings, wherein.

DESCRIPTION OF THE PREFERRED EMBODIMENTS

Figure 1:
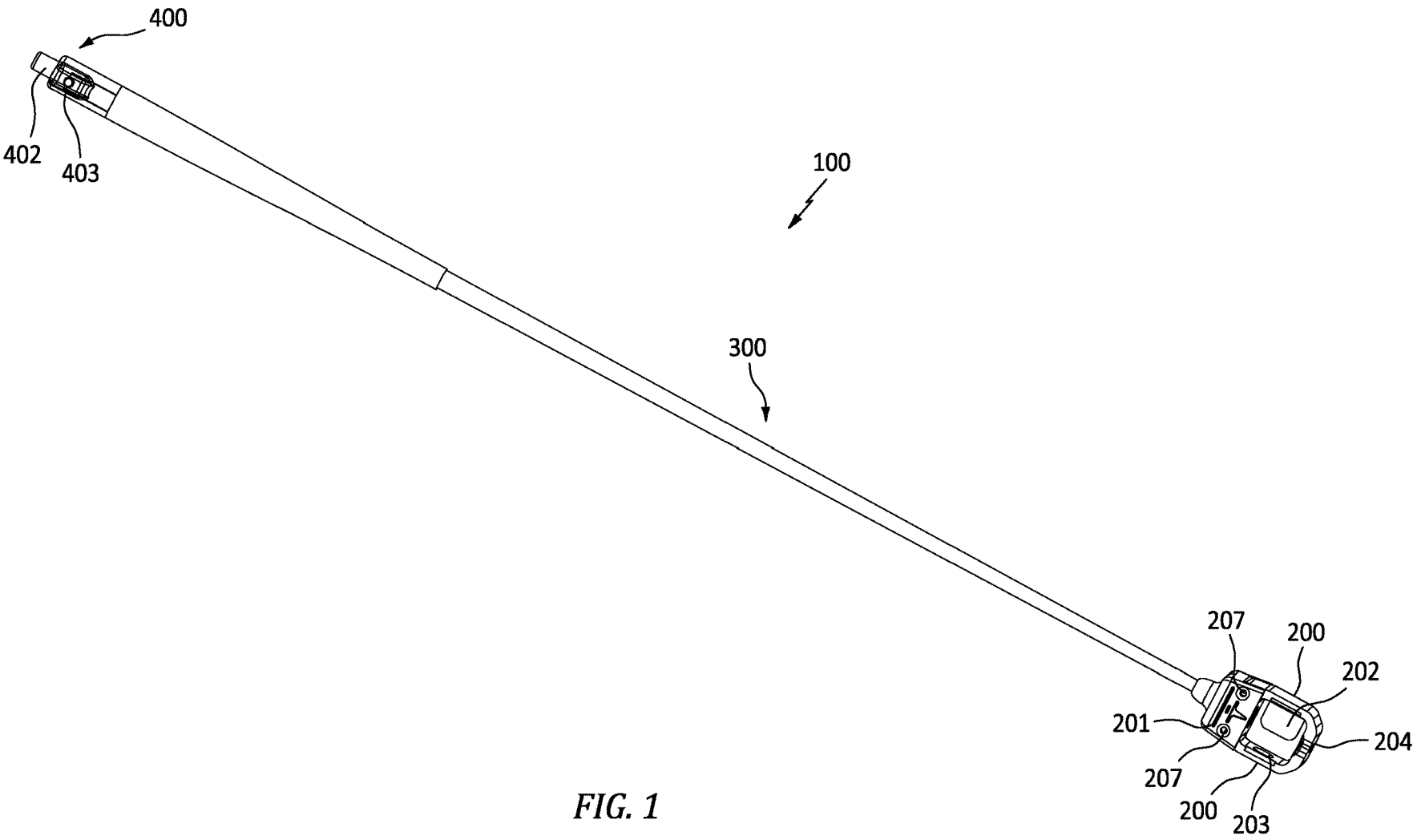
FIG. 1 is a perspective view of an embodiment of the golf ball teeing device.
Figure 2:
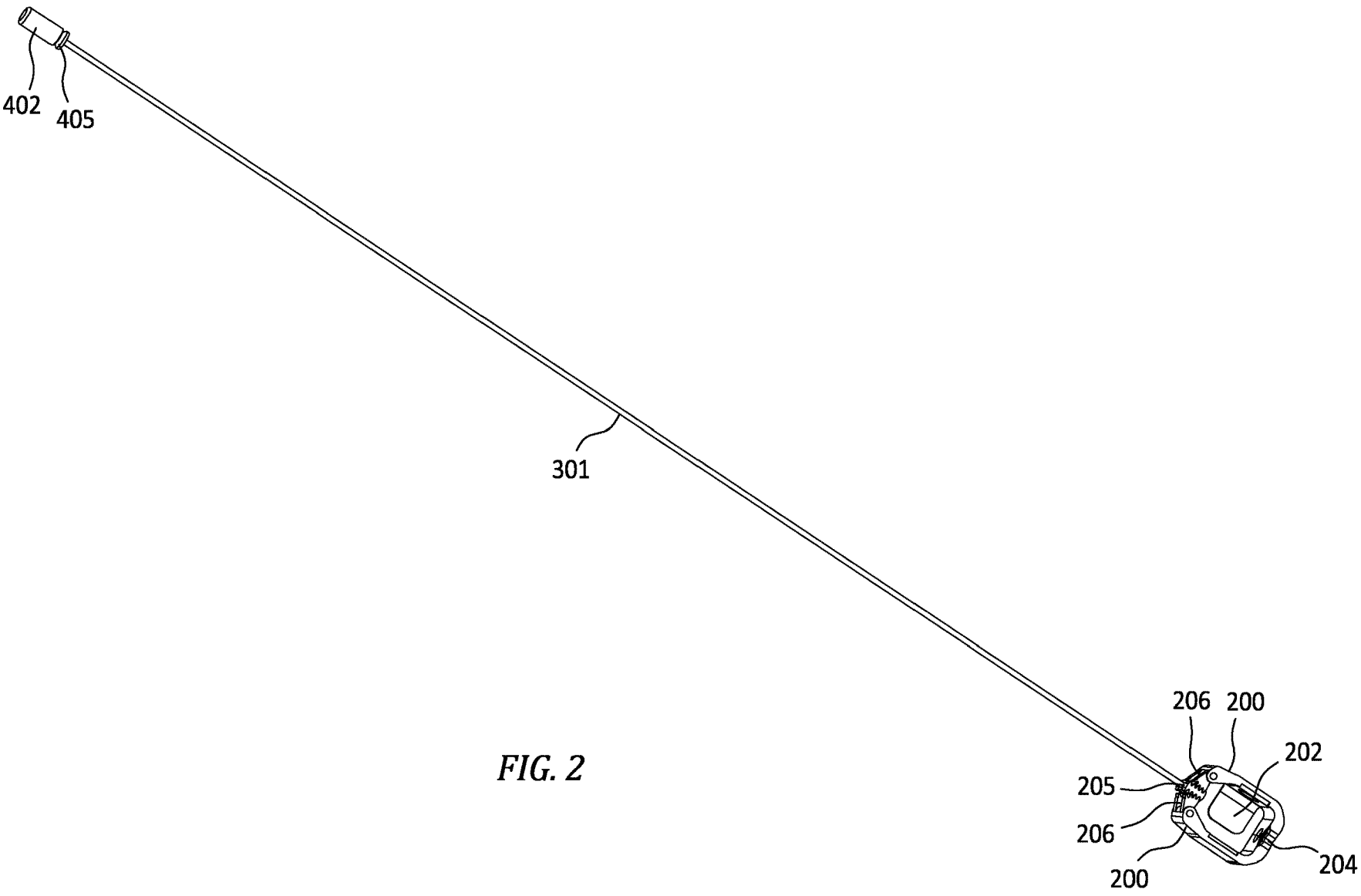
FIG. 2 is a perspective view of the interior mechanisms of FIG. 1.
Figure 3:
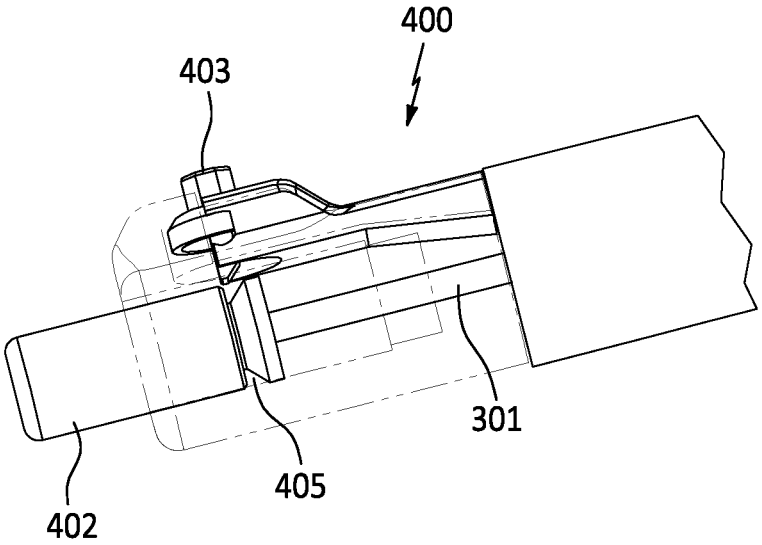
FIG. 3 is a partially transparent perspective view of the top part of the golf ball teeing device.
Figure 4:
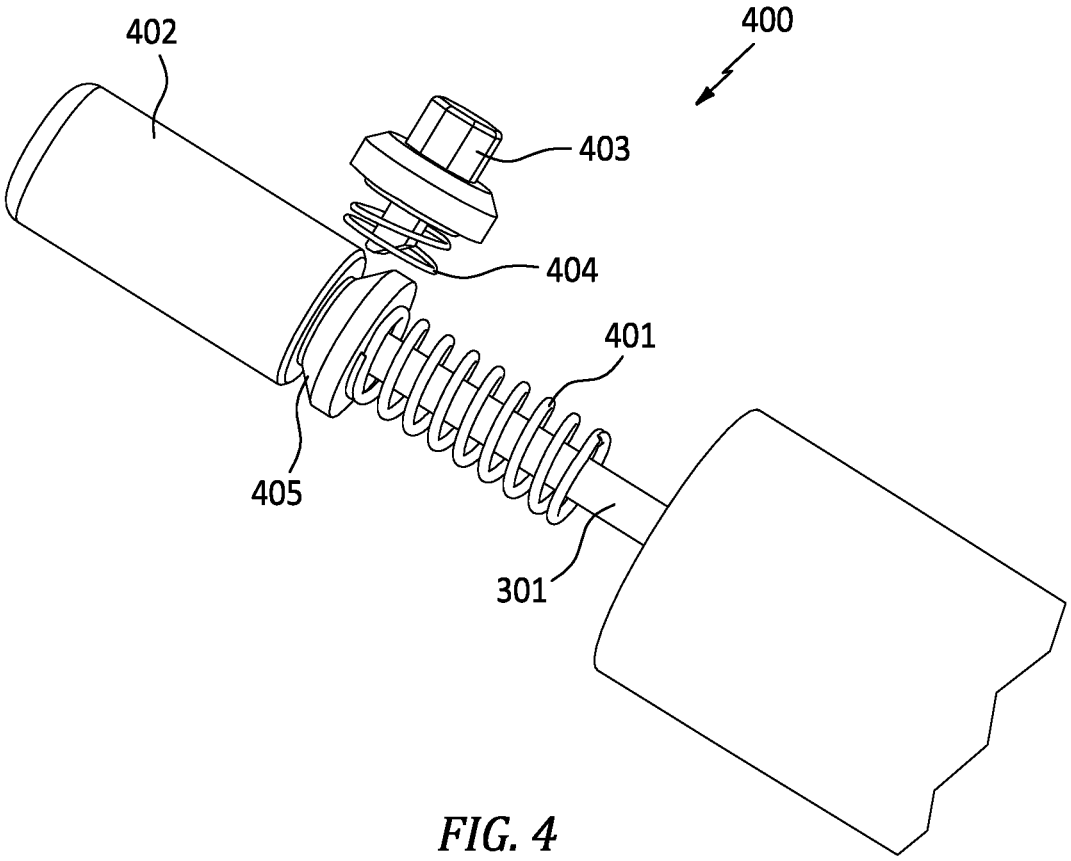
FIG. 4 is a perspective view of the interior mechanism in top part shown in FIG. 3.
Figure 5:
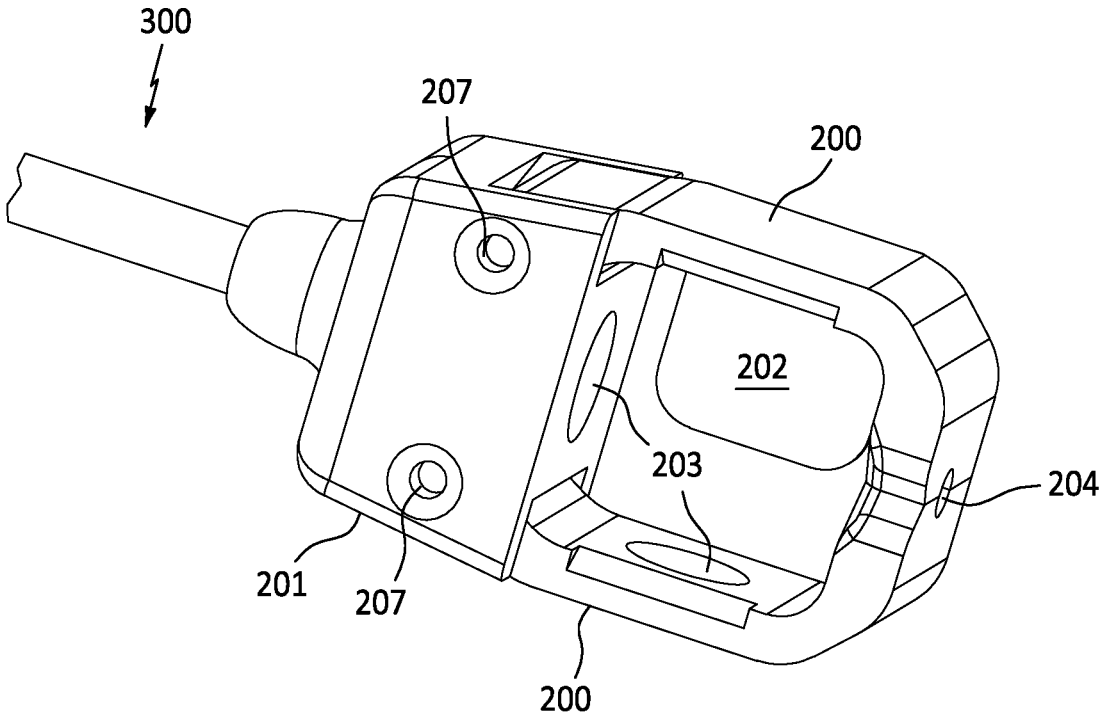
FIG. 5 is a side view of the bottom part of the golf ball teeing device.
Figure 6:
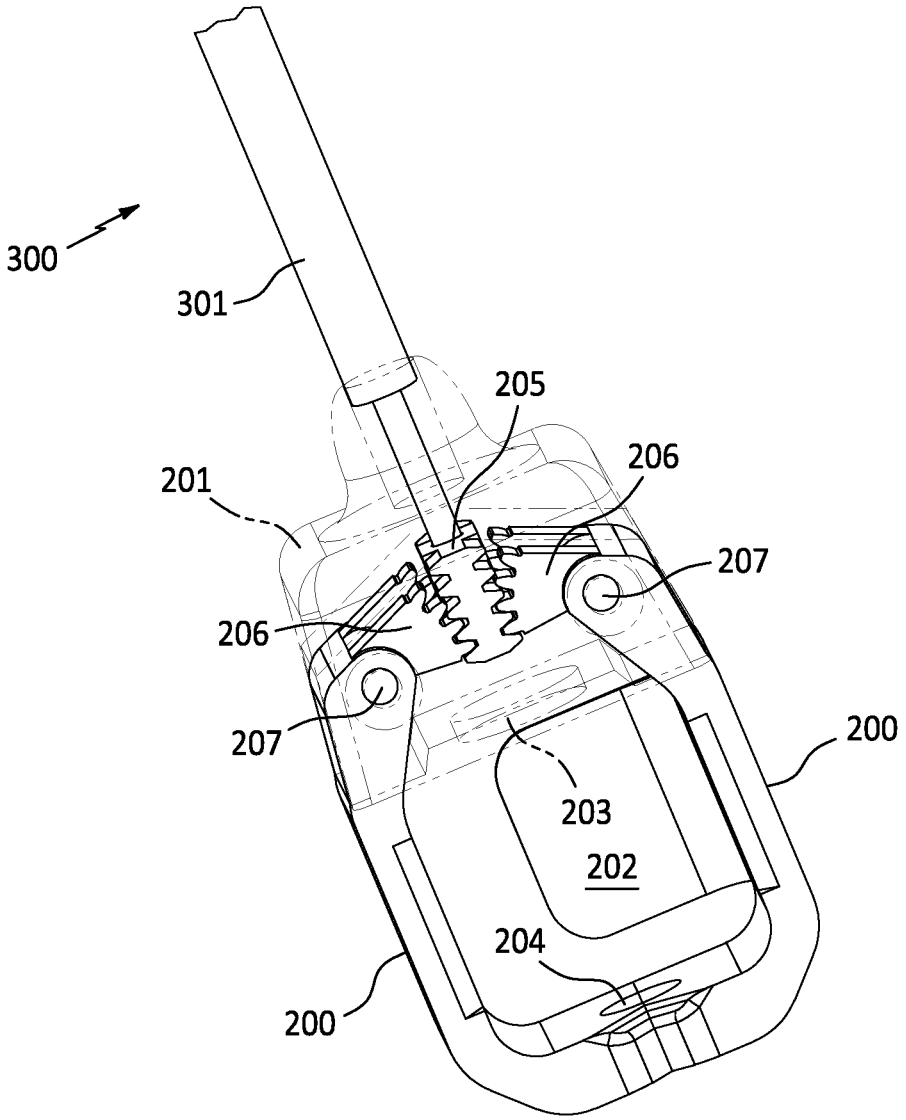
FIG. 6 is a partially transparent side view of the bottom part shown in FIG. 5.
Figure 7:
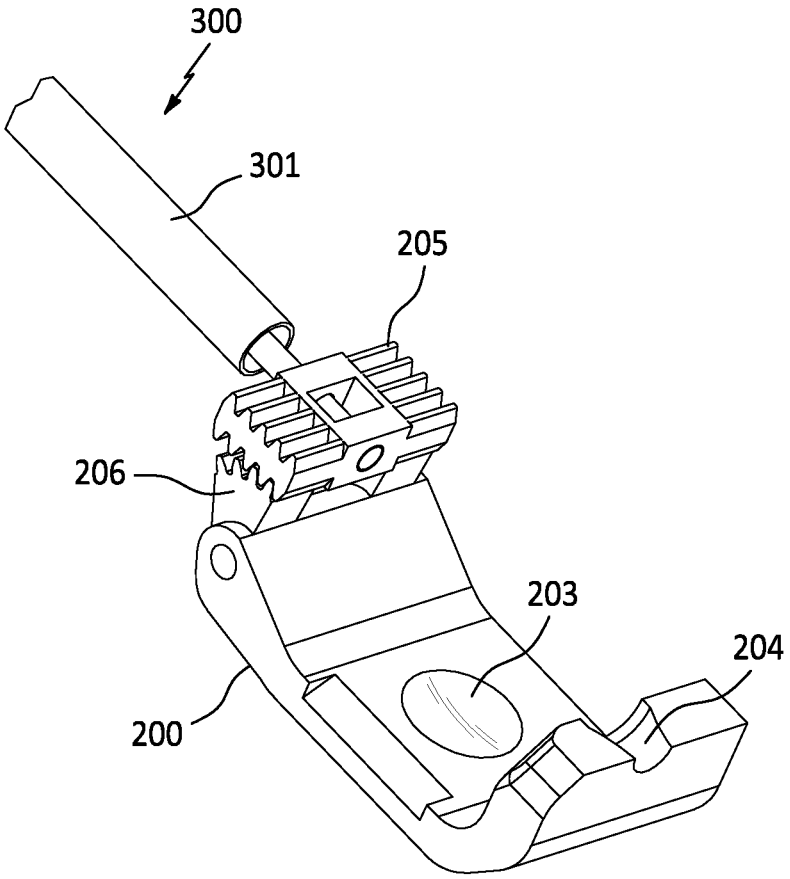
FIG. 7 is a perspective view of a portion of the internal mechanism of the bottom part of the golf ball teeing device of FIG. 6.
Figure 8:
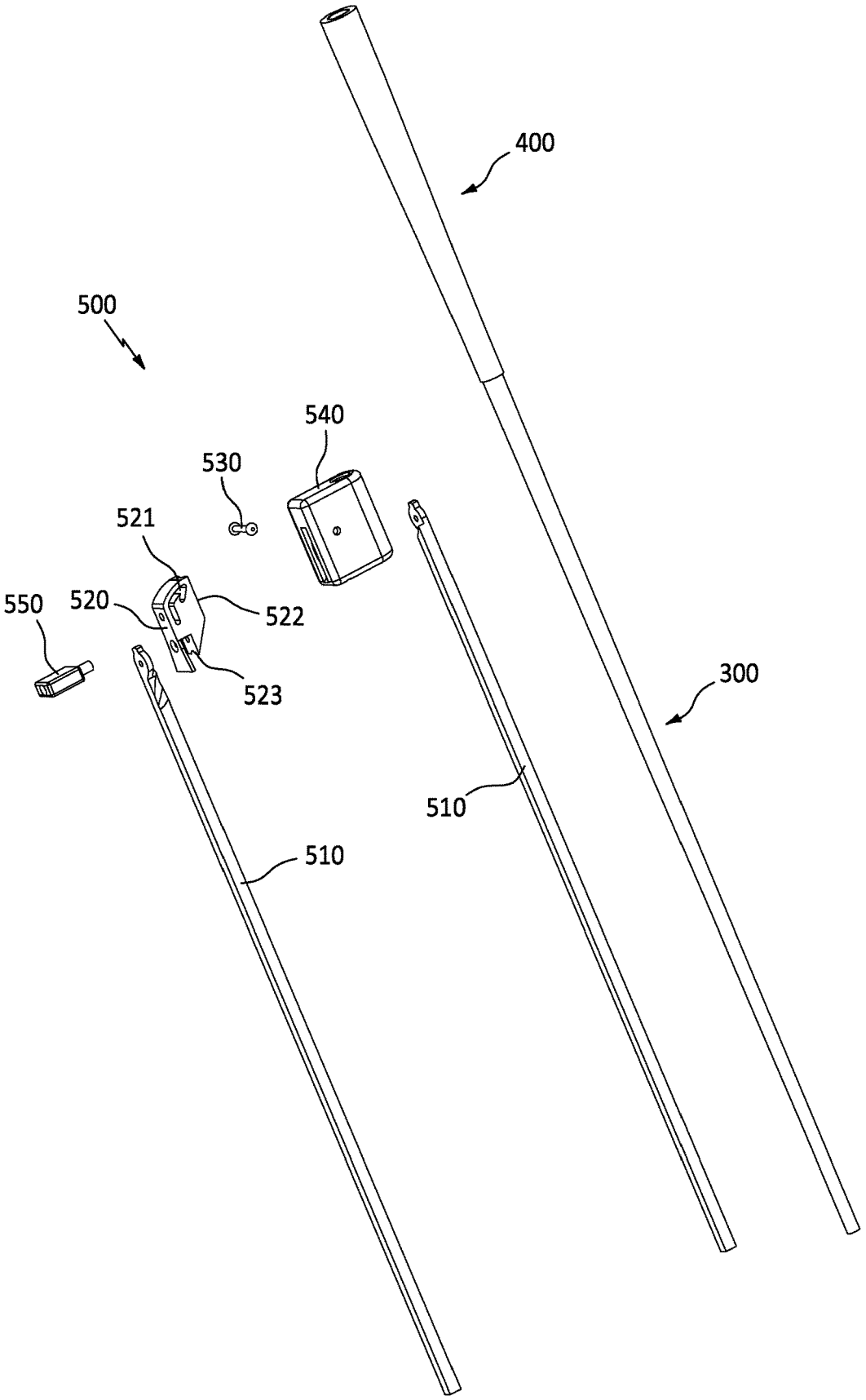
FIG. 8 is an exploded view showing the individual components forming a stand for the golf ball teeing device.
Figure 9:
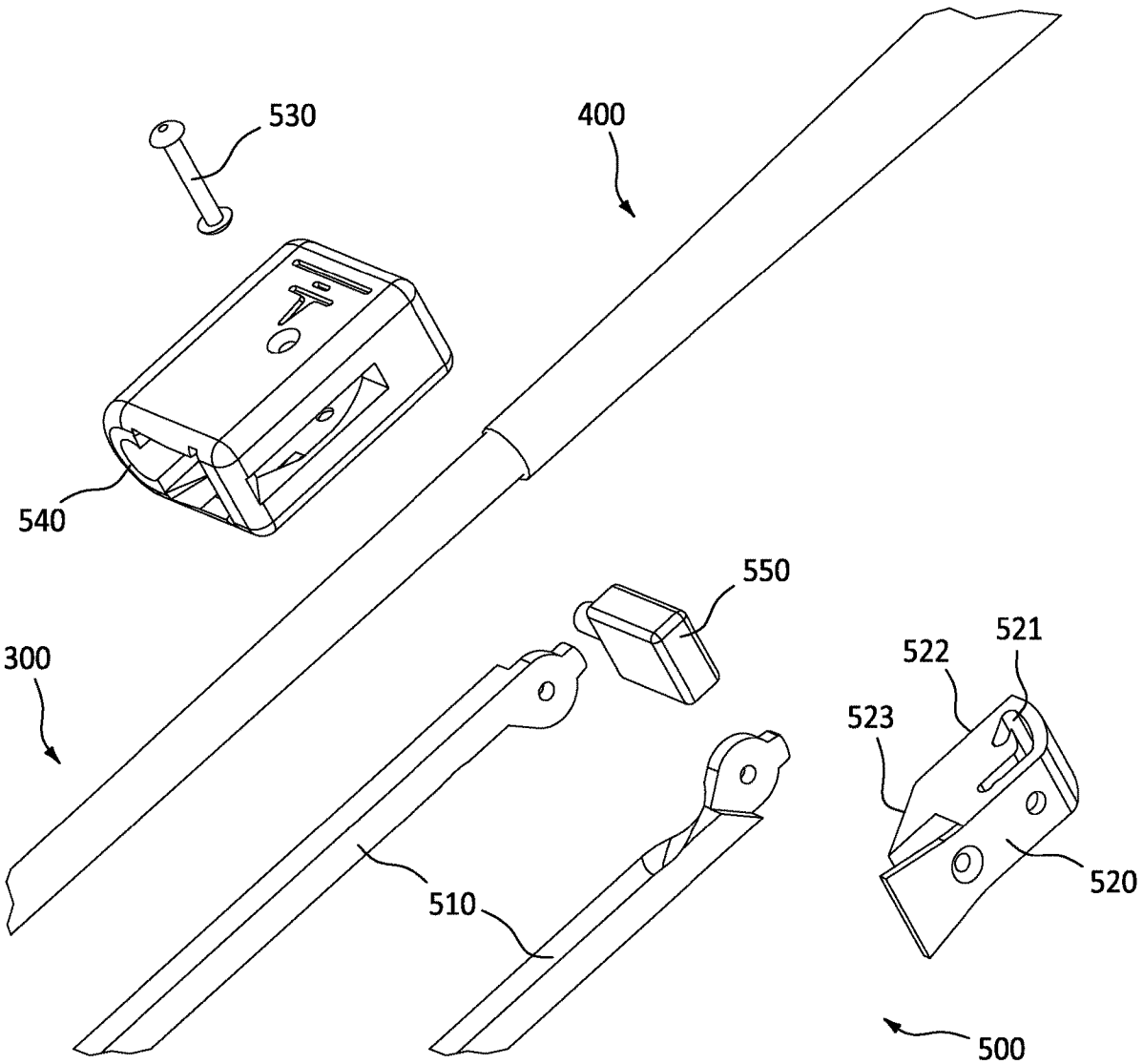
FIG. 9 is an enlarged partial plan view showing the certain of the individual components of FIG. 8.
Figure 10:
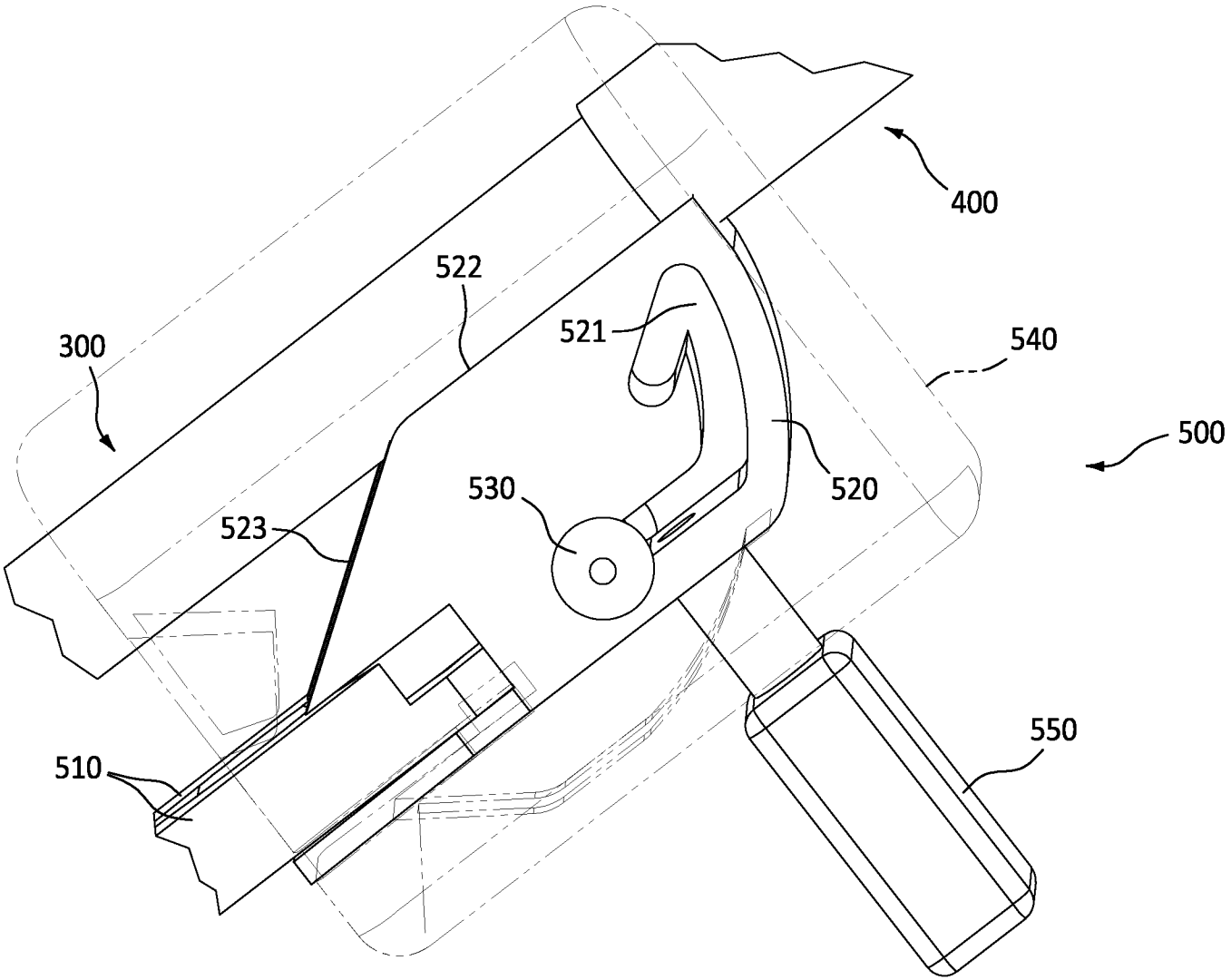
FIG. 10 is an enlarged, partially transparent, perspective view of the top of the stand of FIGS. 8 and 9.
Figure 11:
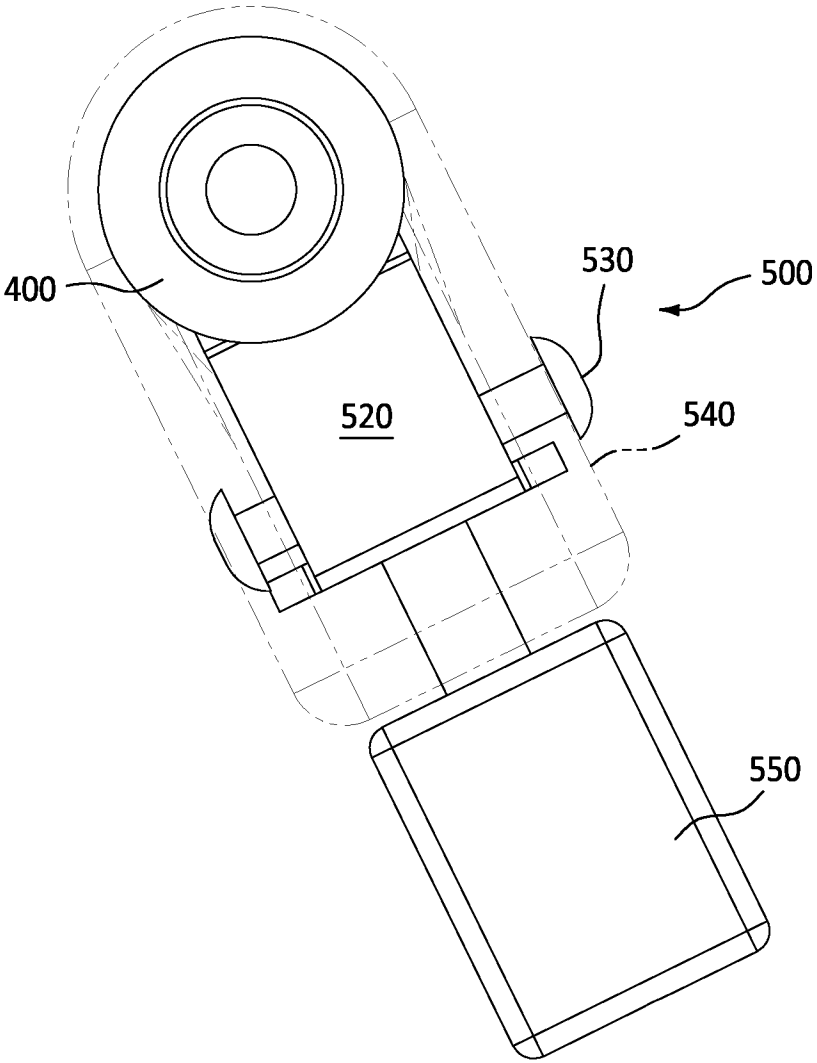
FIG. 11 is a top plan view of the teeing device and stand of FIG. 9, showing the triggering mechanism, FIG. 12 schematically illustrates the stand and golf ball teeing device extended in upright position to support the teeing device, FIG. 13 schematically illustrates the stand and golf ball teeing device retracted together for transport, FIG. 14 schematically illustrates piercing the tee into the ground with the golf ball positioned on top thereof, by the golf ball teeing device, FIG. 15 schematically illustrates lifting the golf ball teeing device away from the mounted golf ball and tee shown in FIG. 14, FIG. 16 schematically illustrates another embodiment of the stand supporting the golf ball teeing device in upright position.

As shown in the figures, the golf ball teeing device 100 has a pair of jaws 200 located at the bottom end and which are connected by a rod 301 to a releasing mechanism 400 at the top of the device 100. A golf ball is first loaded into a closed position of the jaws 200 of the device 100, onto an end of a collar 201 having a receptacle or curved indentation 203 for the ball. One jaw 200 has an L-shaped protrusion 202 to help guide and seat the golf ball during loading and each jaw 200, as well as the collar 201, has a respective curved indentation 203 to effectively seat the golf ball when inserted between the jaws 200 with the tee.

The tee is then loaded on top of the golf ball in the inverted position, by pressing the jaws 200 apart against biasing of the spring 401 at the top end of the gripping handle, and slipped in between the tips of the jaws 200 within the tee opening 204, which then snaps back upon release.

Figure 14:
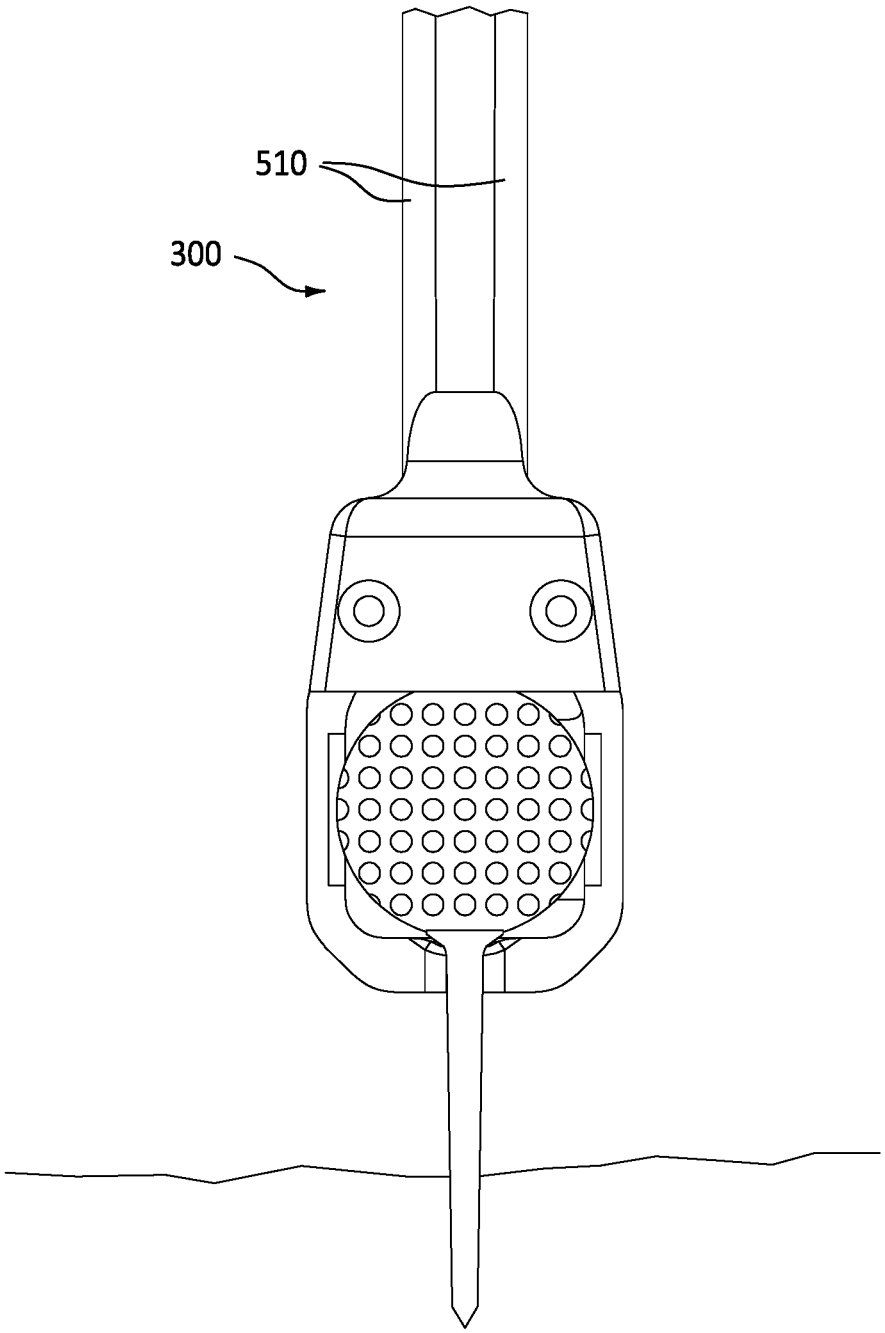
Figure 15:
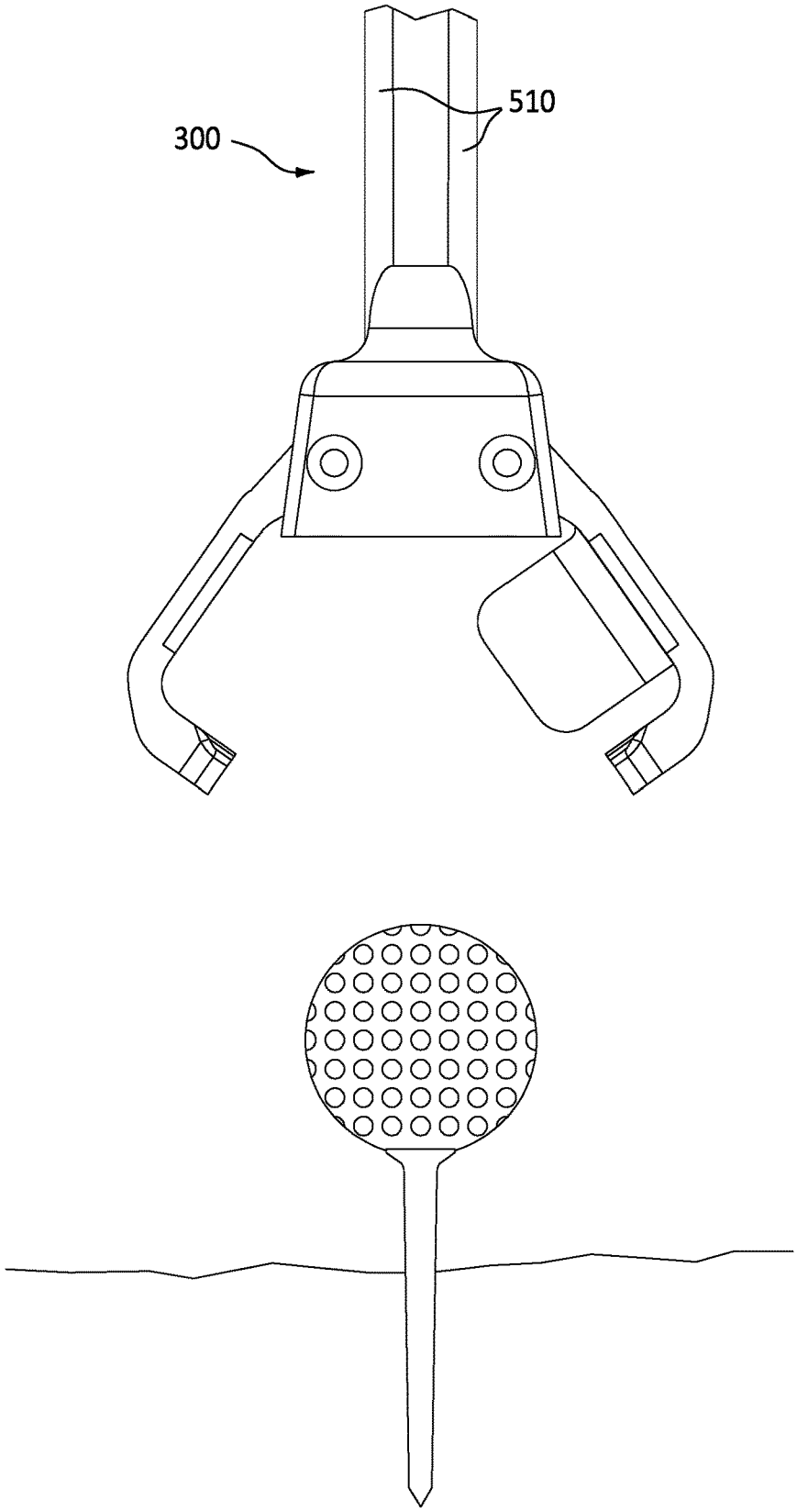

The device 100 is then inverted, as the tee is appropriately pierced into the ground (FIG. 14), i.e., at the teeing off location, driving range, etc. The button 402 within the releasing mechanism 400 is then pressed and opens the jaws 200 to release the golf ball and tee from the device 100 (FIG. 15). Depressing the button 402 pushes the rod 301 situated within the tubular shaft 300 downwardly, and which then moves an opposite end of the rod 301 which is attached to a gear rack 205, thus translating the lateral motion of the rod 301 to a rotational motion of the pinion gears 206 attached by pivot pins 207 to the jaws 200, to open the jaws 200. The pivot pins 207 pass through a collar 201 mounted on the end of the tubular shaft 300, and attach the jaws 200 to the pinion gears 206. The collar 201 securely holds the jaws 200 and pinion gears 206 in place relative to the gear rack 205. Other attachment means of the jaws 200 to the pinion gears 206 are contemplated.

When the button 402 is then released as the teeing device is lifted up and away from the golf ball and tee pierced into the ground (FIG. 15), the jaws 200 return to closed position by the action of the biasing compression spring 401 located within the releasing mechanism 400, extending around the internal rod 301, and coupled to the actuating button 402. The releasing mechanism 400 is formed as a handle similar to a golf club gripping end, with another locking button 403 integrated into the releasing mechanism 400 and which can be used to lock the actuating button 402 in the closed position of the jaws 200 by inserting into a groove 405 of the button 402. The locking button 403 is held against tension of a locking spring 404 and can be easily released to allow the device to be actuated by depressing the actuating button 402. This locking can ensure the device 100 remains closed during transport as well as keeping the jaws 200 closed during use. The locking button is arranged to engage and lock the actuating button from triggering, from only the side of the actuating button on which the locking button is mounted.

The present invention also facilitates picking up the tee and golf ball. For example, the button 402 can be depressed to move the jaws 200 apart against the action of the spring 401, and placed over the tee or golf ball. Then, releasing the button 402 will allow the jaws 200 to close around the golf ball or tee and, with the locking button 403 engaged to ensure jaws 200 remained closed, the golf ball or tee can then be lifted without a golfer bending down.

Figure 12:
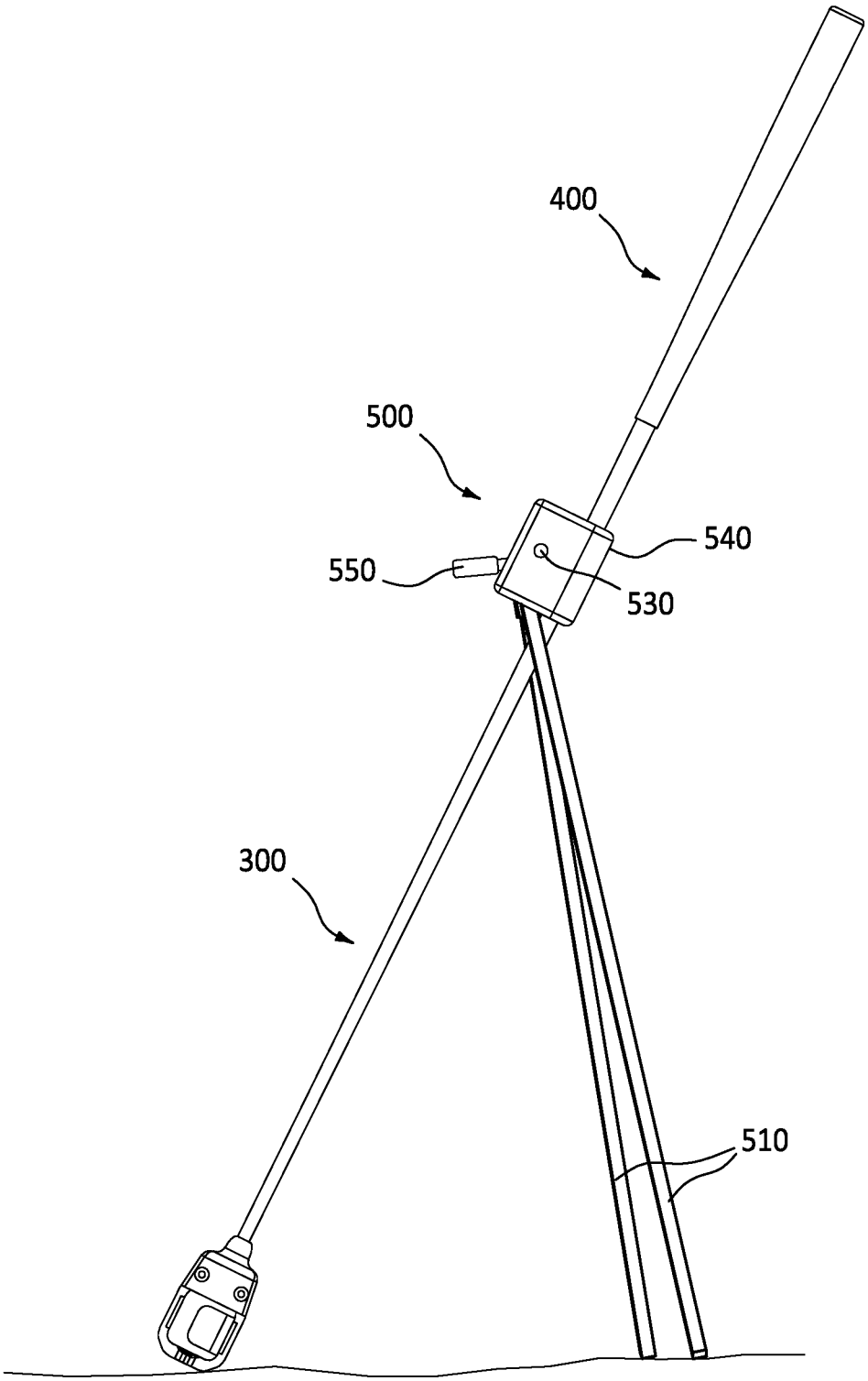
Figure 13:
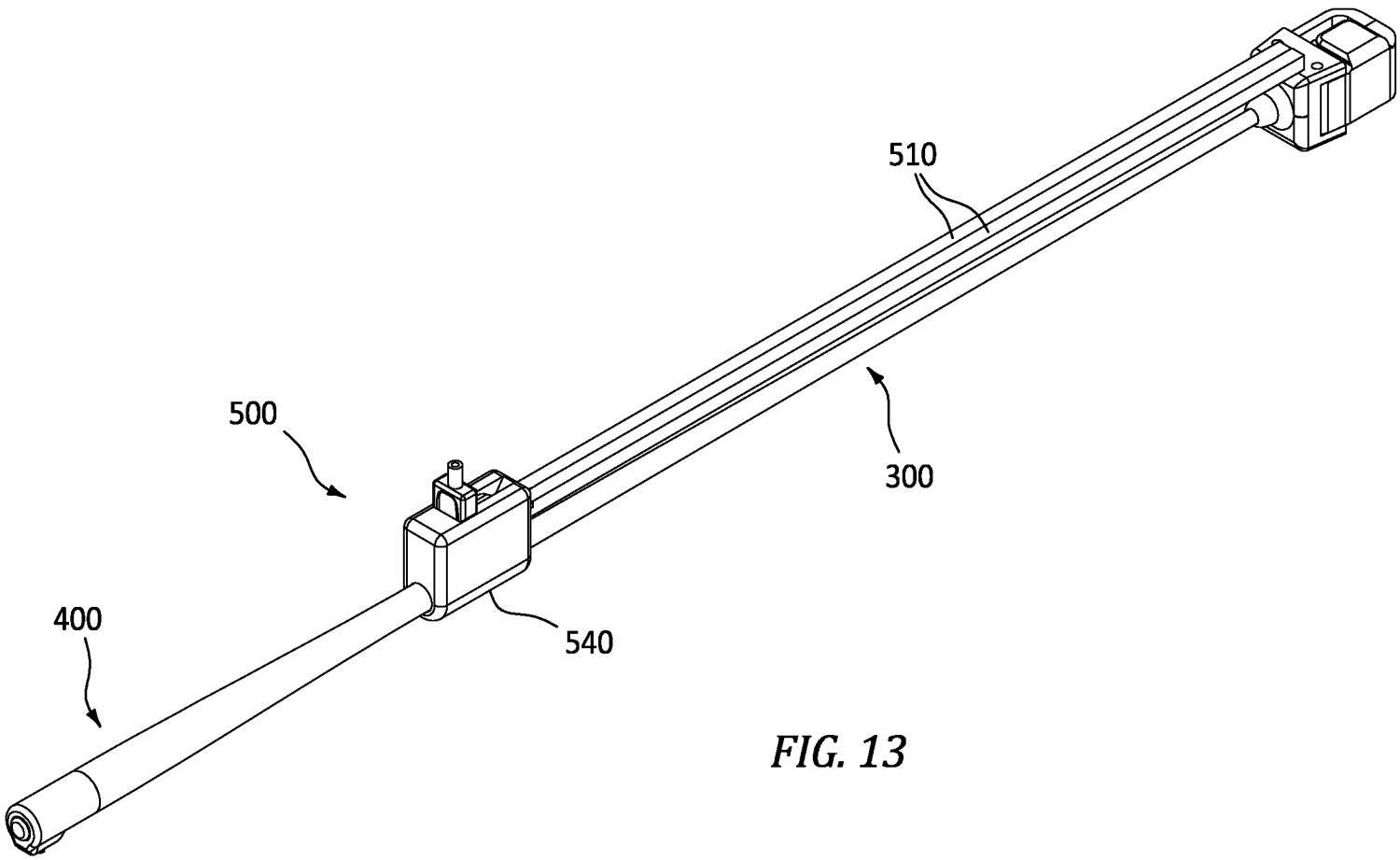

While the device 100 can readily fit within a standard golf bag, a stand 500 is also provided to allow the device 100 to be balanced in upright position, without having to be laid along the ground, as best seen in FIGS. 12 and 13. The stand 500 is not intended to be limited to only the device presented, but any rod-shaped device such as a golf club, fishing pole, or any other device primarily consisting of a rod. The stand 500 works in conjunction with the device 100 to form a tripod. The stand 500 has two additional legs 510 affixed to a slider 520. The slider 520 has a cavity, i.e., an eccentrically-winding channel 521 allowing travel along a predetermined path relative to a stationary retaining pin 530 extending therethrough. The slider 520 also has two edges or camming surfaces, a first leading edge 522 and second angled leading edge 523, both of which are formed to mate with the tubular shaft 300.

The stand 500 is enclosed by a housing 540 permanently attached to the device 100, and the retaining pin 530 holds the slider 520 within the housing 540. The slider 520 also has a lever 550 affixed and stationary relative to the slider 520. FIG. 13 shows the stand legs 510 retracted against the shaft 300 of the teeing device 100, e.g., for carrying and/or inserting in a golf bag.

To extend and mount the legs 510 of the stand, one presses down on the lever 550 which causes the slider 520 to follow the path guided by the retaining pin 530 extending through the cavity 521, in a motion that initially lowers the legs 510, thus moving the first leading edge 522 that is mated with the tubular shaft 300, and then projecting the legs 510 outwardly and away from one another, by engaging the second leading edge 523 mated with the tubular shaft 300, to form a tripod with the teeing device 100 itself (FIG. 12).

Placing the tripod on the ground will also cause upward pressure, stabilizing the device 100. The legs 510 are also shaped to extend around the shaft 300 when engaged. While the drawings depict the stand 500 permanently attached to the device 100, other attachment means, both permanently and semi-permanently, are contemplated.

An advantage provided by this type of stand 500 coupled to the teeing device 100, is moving the pair of legs 510 of the stand away from a user to reliably mount the teeing device 100 upright with swift action and the teeing device 100 itself forming the third leg of a tripod mounting. This makes it easier for a golfer to mount the teeing device upright between use.

Figure 17:
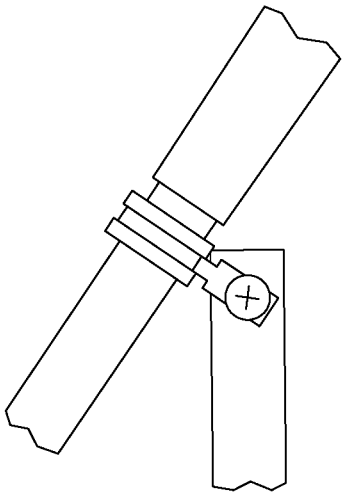
FIG. 17 is an enlarged view of the dotted encircled area in FIG. 16.
Figure 16:
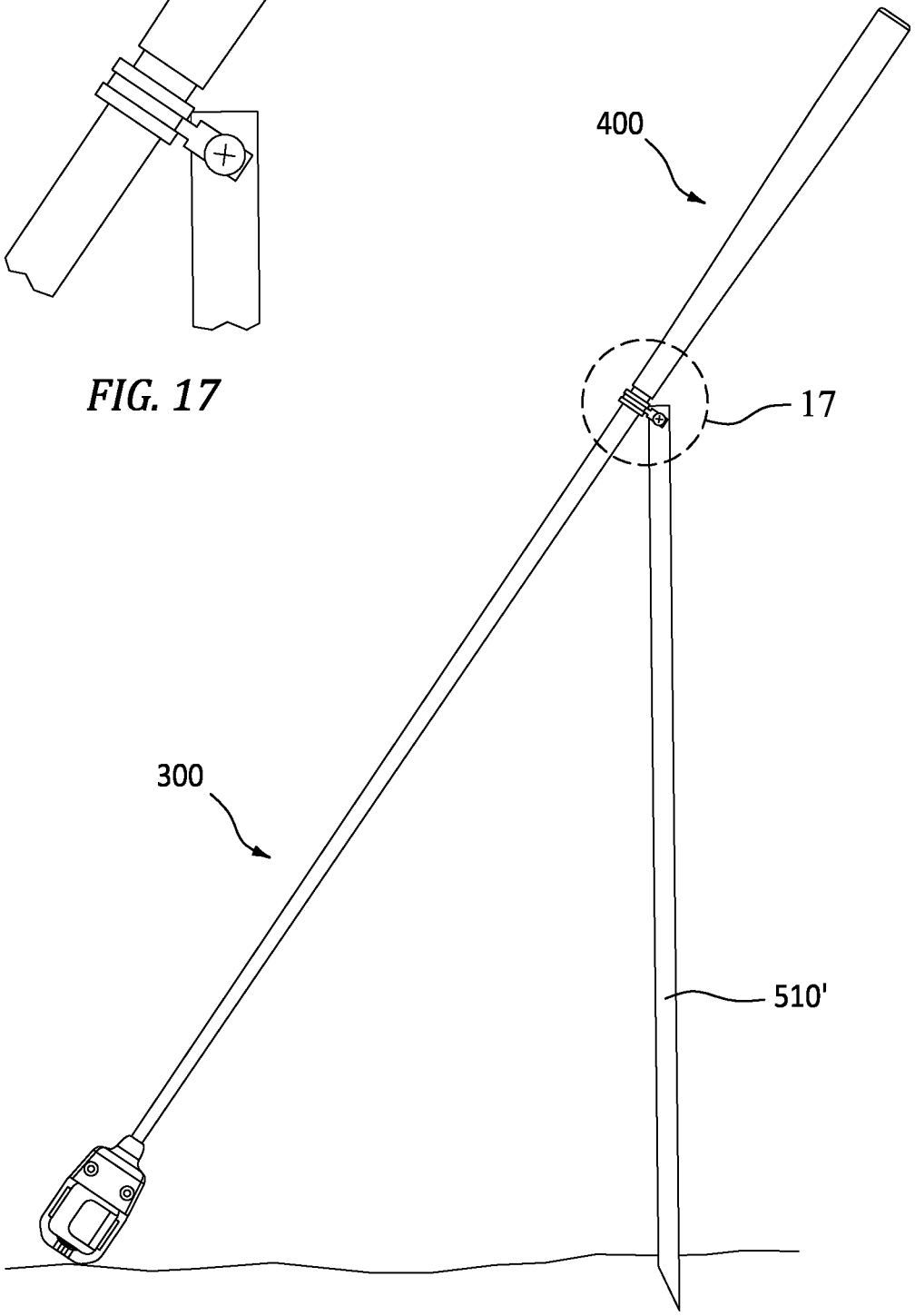

FIGS. 16 and 17 illustrate another type of stand for supporting the golf ball teeing device in upright position, in which the stand has just a single support leg 510'. In this embodiment, a collar encircles the shaft of the golf ball teeing device, and has a laterally extending clamping projection with a bore therethrough. This bore extends substantially perpendicularly to the opening through the collar and encircling the shaft.

The support leg in this embodiment has an opening at the top end to receive a pivot pin or screw which also extends through the bore of the clamping projection. This pivot pin or screw is tightened to secure the collar around the shaft of the teeing device while, at the same time, allowing the stand leg to be pivoted toward or away from the teeing shaft. Therefore, the stand leg 510' is pivotal away from the golf ball teeing device shaft to support the golf ball teeing device at an angle in upright position as shown in FIG. 16 (and is provided with a sharp bottom end to effectively pierce the ground).

The preceding description of the present invention is merely exemplary and not intended to limit the scope thereof in any way.

What is claimed is:

1. A golf ball teeing device, comprising a seat for a golf ball, a pair of jaws arranged on either side of the golf ball seat and forming an opening for a tee for the golf ball at mating ends thereof, means for biasing the jaws together, a rod arranged to open the jaws against the biasing means and release the golf ball and tee from therebetween, a tubular shaft on which the jaws are pivotally mounted, and through which the rod movably extends along the shaft, the rod being configured, when pushed, to contact the jaws and pivotally open them against said biasing means, a meshing gear situated at an end of the rod, and a pair of meshing gears each pivotally arranged on a respective jaw and interlocking with the meshing gear at the end of the rod, such that pushing the rod against the action of the biasing means pivots the jaws outwardly from one another, wherein one of the jaws has an additional L-shaped protrusion to help guide and seat a golf ball during loading and teeing, and extending from said one jaw along one side of said golf ball seat towards the other of the jaws between said shaft and said golf ball tee opening defined by said jaws.

2. The device of claim 1, additionally comprising an actuating button movably mounted upon a spring extending around an opposite end of the rod from the jaws, said spring constituting said biasing means, such that depressing the button, forces the jaws apart against biasing action of the spring.

3. The device of claim 1, additionally comprising a stand pivotally mounted on the tubular shaft.

4. The device of claim 2, additionally comprising a locking button arranged to seat in a groove on the actuating button and lock the same against triggering opening of the jaws.

5. The device of claim 3, wherein the stand comprises a pair of legs arranged to pivot downwardly and outwardly in parallel to support the device in upright position.

6. The device of claim 5, wherein the stand additionally comprises a housing at an upper end thereof, and having a through-hole through which the device extends.

7. The device of claim 1, additionally comprising a collar mounted at an end of the tubular shaft and on which the jaws are pivotally mounted, the collar having a receptacle on a surface thereof for a golf ball.

8. The device of claim 4, additionally comprising a second spring on which said locking button is movably mounted to lock the jaws from triggering against biasing action of the second spring.

9. The device of claim 8, wherein the locking button is arranged to engage and lock the actuating button from triggering, from only the side of the actuating button on which the locking button is mounted.

10. The device of claim 8, wherein the actuating and locking buttons are mounted substantially perpendicular to one another.

11. Mechanism for locking a golf ball teeing device against opening and comprising a locking button arranged to laterally reciprocate in a groove on an actuating button arranged to open jaws coupled thereto and release a golf ball and tee held between the jaws when depressed, and a spring arranged to bias said locking button away from said groove, such that when said locking button is depressed and held against action of said spring, said actuating button is locked against movement, and when said locking button is released, said actuating button is unlocked and free to move, wherein the locking button is entirely arranged on one side of said actuating button, the locking button is positioned to be inserted into the groove of the actuating button by being depressed, and said groove is located between a top end of said actuating button and a compression spring biasing said actuating button in a direction away from said locking button.

12. A golf ball teeing device, comprising a seat for a golf ball, a pair of jaws arranged on either side of the golf ball seat and forming an opening for a tee for the golf ball at mating ends thereof, means for biasing the jaws together, a rod arranged to open the jaws against the biasing means and release the golf ball and tee from therebetween, a tubular shaft on which the jaws are pivotally mounted, and through which the rod movably extends along the shaft, the rod being configured, when pushed, to contact the jaws and pivotally open them against said biasing means, a meshing gear situated at an end of the rod, a pair of meshing gears each pivotally arranged on a respective jaw and interlocking with the meshing gear at the end of the rod, such that pushing the rod against the action of the biasing means pivots the jaws outwardly from one another, a locking button arranged to laterally reciprocate in a groove on an actuating button arranged to open the jaws coupled thereto and release a golf ball and tee held between the jaws when depressed, and a spring arranged to bias said locking button away from said groove, such that when said locking button is depressed and held against action of said spring, said actuating button is locked against movement, and when said locking button is released, said actuating button is unlocked and free to move.

13. The device of claim 1, wherein one end of said L-shaped protrusion is affixed to said one jaw, and an opposite end of said L-shaped protrusion extends toward said other jaw in a perpendicular direction.

14. The device of claim 13, wherein said other end of said L-shaped protrusion extends between said two jaws in a direction perpendicular to a pivoting axis of said two jaws.

15. The device of claim 14, wherein said L-shaped protrusion is positioned to extend between said meshing gear and the mating end of said jaws.

* * * * *